US011621116B2

(12) United States Patent
Kouden

(10) Patent No.: US 11,621,116 B2
(45) Date of Patent: Apr. 4, 2023

(54) MULTILAYER INDUCTOR

(71) Applicant: Murata Manufacturing Co., Ltd., Kyoto-fu (JP)

(72) Inventor: Baku Kouden, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 327 days.

(21) Appl. No.: 16/915,519

(22) Filed: Jun. 29, 2020

(65) Prior Publication Data

US 2021/0065962 A1 Mar. 4, 2021

(30) Foreign Application Priority Data

Aug. 29, 2019 (JP) ..... JP2019-156231

(51) Int. Cl.

| | |
|---|---|
| ***H01F 27/28*** | (2006.01) |
| ***H01F 41/04*** | (2006.01) |
| ***H01F 27/29*** | (2006.01) |

(52) U.S. Cl.

CPC ..... *H01F 27/2804* (2013.01); *H01F 27/29* (2013.01); *H01F 41/041* (2013.01); *H01F 2027/2809* (2013.01)

(58) Field of Classification Search

CPC .... H01F 27/2804; H01F 27/29; H01F 41/041; H01F 2027/2809; H01F 27/292; H01F 17/0013

See application file for complete search history.

(56) References Cited

U.S. PATENT DOCUMENTS

2017/0301453 A1* 10/2017 Jo ..... H01F 17/0013
2018/0096778 A1 4/2018 Yatabe et al.

FOREIGN PATENT DOCUMENTS

| | | | |
|---|---|---|---|
| CN | 107887105 | A | 4/2018 |
| JP | 4941585 | B2 | 5/2012 |
| JP | 2017-191923 | A | 10/2017 |
| JP | 2018-061008 | A | 4/2018 |

OTHER PUBLICATIONS

An Office Action; "Notice of Reasons for Refusal," mailed by the Japanese Patent Office dated Mar. 15, 2022, which corresponds to Japanese Patent Application No. 2019-156231 and is related to U.S. Appl. No. 16/915,519 with English language translation.

* cited by examiner

*Primary Examiner* — Wei (Victor) Y Chan
(74) *Attorney, Agent, or Firm* — Studebaker & Brackett PC

(57) ABSTRACT

A component main body has end surface layers having a relatively high rigidity and a low-strength layer having a relatively low rigidity. The end surface layer includes a first end surface layer configuring a first end surface of the component main body, and a second end surface layer configuring a second end surface. A thickness of the first end surface layer is made thicker than a thickness of the second end surface layer. When the thickness of the first end surface layer is made larger than the thickness of the second end surface layer under a condition that a total thickness is constant, the thickness of the first end surface layer can be thickened as compared to a case where both of the thicknesses are equal to each other. Such thickened first end surface layer can give high mechanical strength to the component main body.

20 Claims, 4 Drawing Sheets

MULTILAYER INDUCTOR

CROSS-REFERENCE TO RELATED APPLICATION

This application claims benefit of priority to Japanese Patent Application No. 2019-156231, filed Aug. 29, 2019, the entire content of which is incorporated herein by reference

BACKGROUND

Technical Field

The present disclosure relates to a multilayer inductor having a structure in which a coil conductor is disposed inside a component main body having a multilayer structure made of a non-conductive material, and particularly relates to an improvement for improving the strength of a multilayer inductor.

Background Art

As a technique of interest for the present disclosure, there is, for example, a technique described in Japanese Patent No. 4941585. In Japanese Patent No. 4941585, as a specific embodiment, a multilayer chip capacitor is described instead of a multilayer inductor, however, in this chip capacitor, an identification layer having a color different from that of another ceramic layer is provided at both end portions in a lamination direction in a component main body of a substantially rectangular parallelepiped shape having a multilayer structure. The identification layer is configured to make it possible to visually recognize an arrangement direction of conductors disposed inside the component main body.

In Japanese Patent No. 4941585, it is described that in order to make the color of the identification layer different from that of the other ceramic layers, for example, average particle sizes of the ceramic particles configuring respective layers are made to be different from each other, additives contained in the respective layers are made to be different from each other, and composition ratios of the ceramic material configuring the respective layers are made to be different from each other.

In Japanese Patent No. 4941585, with regard to the identification layer, there is no description of a function other than a function that the arrangement direction of the conductor disposed inside the component main body can be visually identified.

On the other hand, in the development of a multilayer inductor, inventors of the present disclosure have taken note of the example in which a composition of the above-described identification layer is different from compositions of the other ceramic layers, and have focused on the possibility that the identification layer may have a function other than the above-described function, for example, a function that mechanical strength of the multilayer inductor is improved. Namely, the possibility is that since the identification layer is provided at both end portions in the lamination direction of the component main body, when the identification layer has high mechanical strength, the identification layer may contribute to the improvement of the mechanical strength of the multilayer inductor.

The mechanical strength of the multilayer inductor becomes a problem, for example, during a reflow soldering process or a deflection test, and as the mechanical strength is lower, distortion or warpage generated in the multilayer inductor increases, and the multilayer inductor may generate a crack.

SUMMARY

Therefore, the present disclosure provides a multilayer inductor structure capable of further improving mechanical strength by focusing on the function of the above-described identification layer.

The present disclosure relates to a multilayer inductor including a component main body that is made of a non-conductive material, has a rectangular parallelepiped shape or a substantially rectangular parallelepiped shape having a multilayer structure, and has a first end surface and a second end surface positioned at end portions in a lamination direction and opposed each other, a first side surface and a second side surface connecting between the first end surface and the second end surface and opposed each other, and a top surface and a bottom surface connecting between the first end surface and the second end surface and between the first side surface and the second side surface and opposed each other. The multilayer inductor also includes a coil conductor that includes a first end portion and a second end portion exposed on an outer surface of the component main body in mutually reverse manner, is disposed inside the component main body, and includes a circulation portion extending in parallel to the first end surface and the second end surface; a first terminal electrode configured to include the first end portion of the coil conductor; and a second terminal electrode configured to include the second end portion of the coil conductor.

Also, in the present disclosure, the above-described component main body includes a first end surface layer that provides the first end surface, a second end surface layer that provides the second end surface, and a low-strength layer that has a lower rigidity than the first end surface layer and the second end surface layer, and a thickness of the first end surface layer is larger than a thickness of the second end surface layer.

Note that the thickness of the first end surface layer may be larger than the thickness of the second end surface layer, so that the second end surface layer may have a thickness of about 0. In this case, the first end surface is provided by the end surface layer, and the second end surface is provided by the low-strength layer.

Other features, elements, characteristics and advantages of the present disclosure will become more apparent from the following detailed description of preferred embodiments of the present disclosure with reference to the attached drawings.

DETAILED DESCRIPTION

Figure 1:
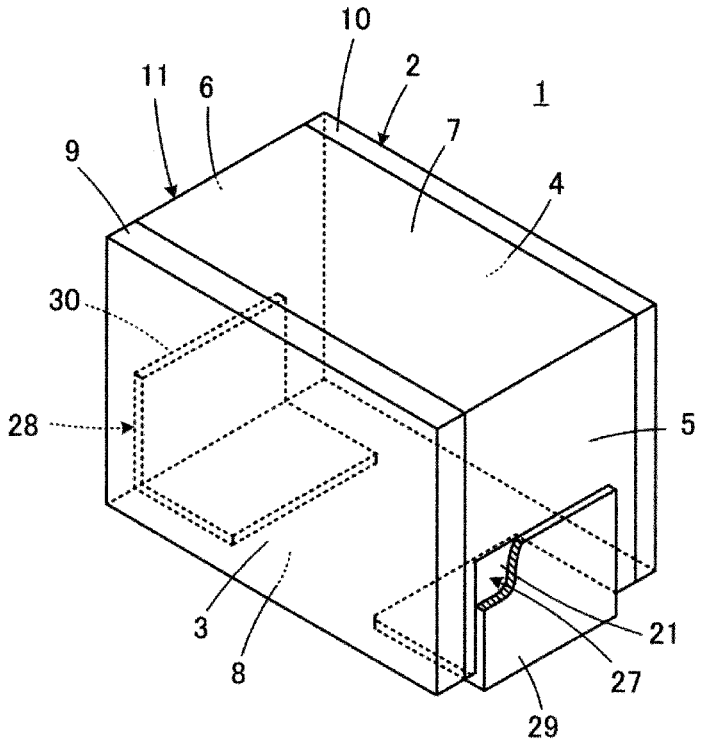
FIG. 1 is a perspective view illustrating an external appearance of a multilayer inductor according to a first embodiment of the present disclosure.
Figure 2:
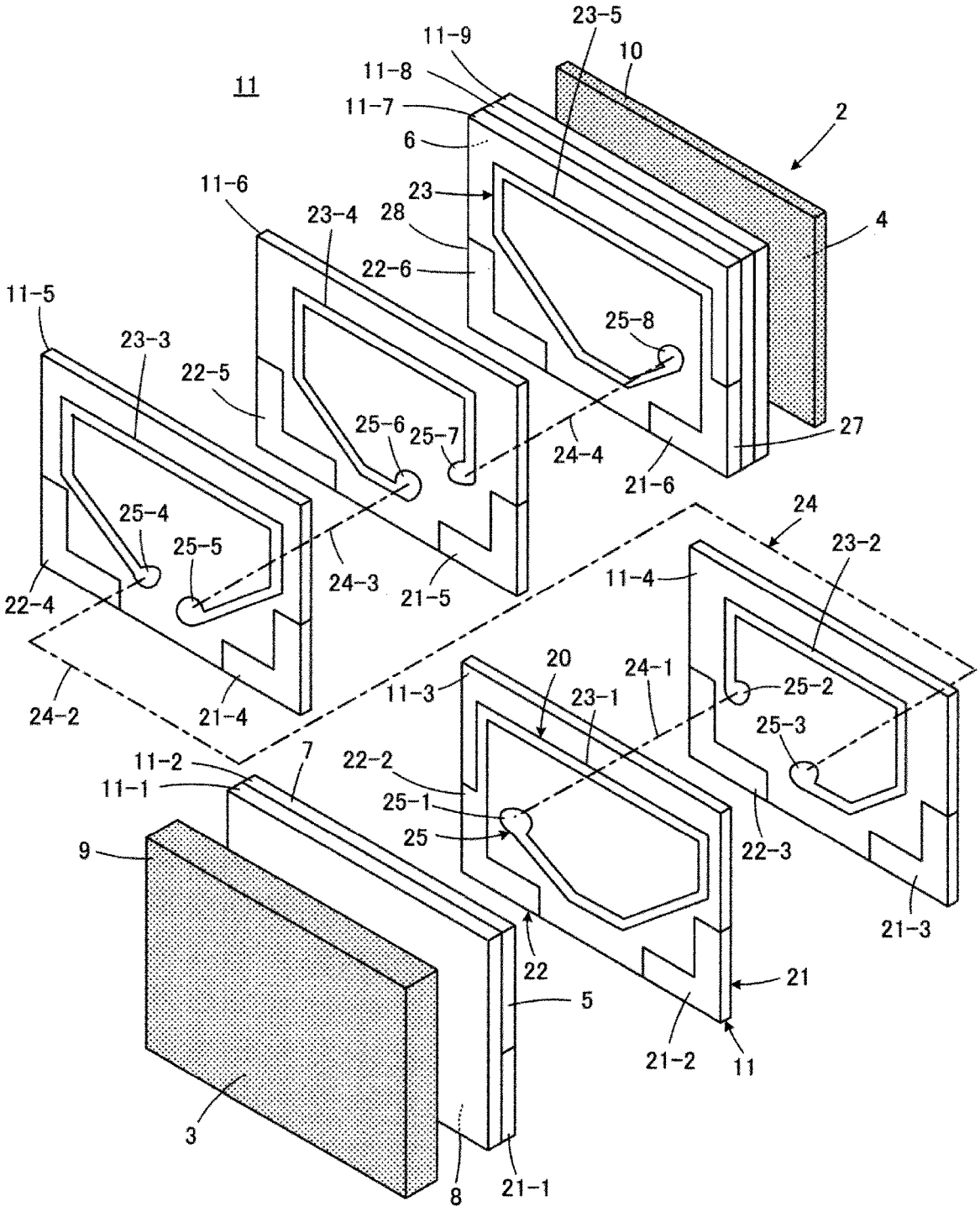
FIG. 2 is a perspective view illustrating the multilayer inductor illustrated in FIG. 1 in an exploded manner, and illustration of a plating film formed on terminal electrodes is omitted.
Figure 3:
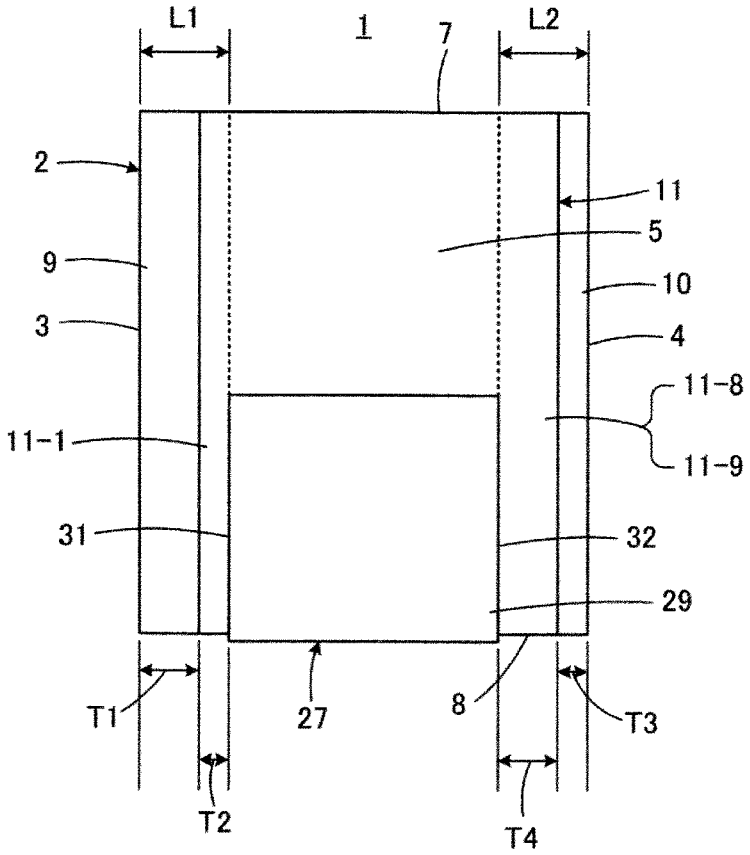
FIG. 3 is a side view illustrating the multilayer inductor illustrated in FIG. 1 from a direction of a first side surface.

Referring to FIG. 1 to FIG. 3, a multilayer inductor 1 according to a first embodiment of the present disclosure will be described.

The multilayer inductor 1 includes a component main body 2 made of a non-conductive material. As illustrated in FIG. 2, the component main body 2 has a multilayer structure. Here, as the non-conductive material, for example, a material obtained by adding a ceramic filler such as ferrite, a metal magnetic filler, or a non-magnetic filler such as silica to glass such as borosilicate glass, is used. Instead of glass, a resin may be used in some cases.

The component main body 2 has a rectangular parallelepiped shape or a substantially rectangular parallelepiped shape. Here, "having the substantially rectangular parallelepiped shape" means that the component main body 2 may have a shape in which, for example, a ridge portion and a corner portion are rounded or chamfered, or that at least one surface of the six surfaces defining a substantially rectangular parallelepiped do not have to be rectangular in a strict sense.

As illustrated in FIG. 1, the component main body 2 includes a first end surface 3 and a second end surface 4 that are positioned at an end portion in a lamination direction, that is, at a start point and an end point in the lamination direction and are opposed each other, a first side surface 5 and a second side surface 6 that connect between the first end surface 3 and the second end surface 4 and are opposed each other, and a top surface 7 and a bottom surface 8 that connect between the first end surface 3 and the second end surface 4 and between the first side surface 5 and the second side surface 6 and are opposed each other.

As illustrated in FIG. 2, the component main body 2 has a multilayer structure configured of a plurality of layers, that is, end surface layers 9 and 10 and a low-strength layer 11 having a lower rigidity than that of the end surface layers 9 and 10. Here, the end surface layers 9 and 10 are classified into a first end surface layer 9 providing the above-described first end surface 3 and a second end surface layer 10 providing the above-described second end surface 4. The plurality of low-strength layers 11 is positioned between the first end surface layer 9 and the second end surface layer 10.

In order to make the end surface layers 9 and 10 have a higher rigidity than the low-strength layer 11, for example, when both contain glass and are made of a combination of a filler and a resin, a content rate of the filler in the end surface layers 9 and 10 is made to be higher than that of the low-strength layer 11. Further, when the end surface layers 9 and 10 and the low-strength layer 11 are made of, for example, a combination of a filler and a resin, the content rate of the filler in the end surface layers 9 and 10 is made higher than that of the low-strength layer 11. Note that in order to improve the mechanical strength, it is also conceivable to configure the entire region of the component main body 2 by a layer corresponding to an end surface layer having a higher rigidity. However, since a coil conductor 20 is disposed in the low-strength layer 11 as will be described later, the low-strength layer 11 employs a composition giving priority to the electrical characteristics and magnetic characteristics relative to the end surface layers 9 and 10.

The coil conductor 20 extending in a spiral shape is disposed in the component main body 2. The coil conductor 20 includes a first end portion 21 and a second end portion 22 opposite to each other, and includes a plurality of circulation portions 23 that extends along any interface between the plurality of low-strength layers 11 and forms a part of an annular rolling inside the component main body 2 so as to connect between the first end portion 21 and the second end portion 22, and a plurality of via-hole conductors 24 that passes through any one of the low-strength layers 11 in a thickness direction. The circulation portion 23 extends in parallel to the first end surface 3 and the second end surface 4.

In the coil conductor 20, the above-described circulation portion 23 and the via-hole conductor 24 are alternately connected to each other, thereby providing a form extending in a substantially spiral shape. A via pad 25 having a relatively large area for connection with the via-hole conductor 24 is provided at an end portion and a specific portion of each of the plurality of circulation portions 23. In FIG. 2, the via-hole conductor 24 is indicated by dashed dotted lines so as to represent an electrical connection state thereof.

The first end portion 21 and the second end portion 22 of the coil conductor 20 are required to be terminals of the coil conductor 20, and are exposed on an outer surface of the component main body 2 while being disposed in a state of being embedded inside the component main body 2. More specifically, as illustrated in FIG. 2, each of the first end portion 21 and the second end portion 22 has a substantially L-shape, and is exposed to the first side surface 5 side and the second side surface 6 side, respectively, with a space from each other on the bottom surface 8 of the component main body 2. Further, the first end portion 21 is exposed to the first side surface 5 while extending to a portion exposed to the bottom surface 8, and the second end portion 22 is exposed to the second side surface 6 while extending to a portion exposed to the bottom surface 8.

As described above, each of the first end portion 21 and the second end portion 22 of the coil conductor 20 is exposed over the two adjacent surfaces of the component main body 2, and a first terminal electrode 27 and a second terminal electrode 28 are configured while including the exposed portions of the first end portion 21 and the second end portion 22, respectively. That is, the first terminal electrode 27 is provided so as to extend over each part of the first side surface 5 and the bottom surface 8, and the second terminal electrode 28 is provided so as to extend over each part of the second side surface 6 and the bottom surface 8. As described above, when the terminal electrodes 27 and 28 are provided, when the multilayer inductor 1 is mounted in or on a mounting substrate, a solder fillet having an appropriate form can be formed, and therefore, it is possible to obtain a highly reliable mounting state in both of the electrical connection and a mechanical bonding.

The first terminal electrode 27 may include a first plating film 29 provided so as to cover an exposed portion of the first end portion 21. The second terminal electrode 28 may include a second plating film 30 provided so as to cover an exposed portion of the second end portion 22. The plating films 29 and 30 can serve to increase solder wettability of the first end portion 21 and the second end portion 22 of the coil conductor 20 containing silver as a conductive component, for example, and to prevent solder erosion.

Further, the plating films 29 and 30 can be efficiently formed in a necessary portion as an underlay for deposition of electroplate of the exposed portions of the first end portion 21 and the second end portion 22. Each of the plating films 29 and 30 is configured of, for example, an underlying nickel plating layer and a tin plating layer thereon. According to this configuration, it is possible to cause the plating films 29 and 30 to advantageously perform the function of improving the solder wettability and preventing solder erosion. Note that, a copper plating layer may be formed instead of the nickel plating layer, or a copper plating layer may be formed between the nickel plating layer and the tin plating layer.

As described above, the component main body 2 has a multilayer structure, but an interface between a plurality of layers that realizes the multilayer structure is mostly disappeared in an actual product by undergoing a firing process or a solidification process. However, assuming that the lamination configuration is present for the sake of convenience, for each of the end surface layers 9 and 10, and for each of the low-strength layers 11, the configuration associated with each layer will be described mainly with reference to FIG. 2.

Note that, in the following description, when a specific one taken out of the plurality of low-strength layers 11 needs to be explained, a reference numeral "11" with a branch number is used, such as "11-1", "11-2", and the like. Also, the reference numerals are used for each of the plurality of circulation portions 23, the plurality of via-hole conductors 24, and the plurality of via pads 25 in a similar way as the case of the above-described low-strength layer 11.

FIG. 2 illustrates the first end surface layer 9, the second end surface layer 10, and nine low-strength layers 11-1, 11-2, . . . , and 11-9. The low-strength layers 11-1, 11-2, . . . , 11-9 are laminated in this order from the first end surface 3 side toward the second end surface 4 side.

When attention is paid to a thickness of each of the first end surface layer 9 and the second end surface layer 10 each positioned at the most end, the thickness of the first end surface layer 9 is made thicker than the thickness of the second end surface layer 10. Because of the following reason, high mechanical strength can be given by thickening even one of the first end surface layer 9 and the second end surface layer 10, instead of thickening both of them.

When the equal external force is applied, the smaller the displacement (warping, deflection) is, the higher the mechanical strength is. When the thicknesses of the end surface layers 9 and 10 increases, the displacement decreases and the mechanical strength increases. The displacement of the end surface layers 9 and 10 is defined by a maximum value of the thickness of each of these two end surface layers 9 and 10. Therefore, under the condition that the sum of the thicknesses of both of the end surface layers 9 and 10 is constant, the mechanical strength can be increased in a case where one of the end surface layers 9 and 10 is thicker than the other than a case where the thicknesses of the two end surface layers 9 and 10 are equal to each other.

Note that in the case where both of the end surface layers 9 and 10 are made thick, an increase in the size of the entire product is caused, and in order to avoid such an increase in size, it is necessary to reduce the size of the coil conductor inside, and the influence on standards and characteristics increases.

Preferably, the thickness of the first end surface layer 9 is made larger than the thickness of the second end surface layer 10 by equal to or more than about 3 μm. Variation in a printing thickness is currently about 2.5 μm at about 3σ, and a value of about 3 μm that exceeds this is a lower limit value that can be judged to have a significant difference as compared to a case where the variation in the printing thickness is maximized. Further, when the difference in thickness between the first end surface layer 9 and the second end surface layer 10 is equal to or more than about 3 μm, the above-described effect of reducing the displacement can be reliably exhibited.

In this way, according to this embodiment, an effect of improving the mechanical strength due to an increase in the thickness of the first end surface layer 9 is exhibited. On the other hand, by reducing the thickness of the second end surface layer 10, it is possible to avoid an increase in the size of the multilayer inductor 1.

Note that an adjustment of the thickness of each of the end surface layers 9 and 10 is achieved by changing the coating thickness at the time of printing, when these are formed by printing. Further, the thickness of each of the end surface layers 9 and 10 may be adjusted by changing the number of laminated sheets having a unit thickness. Further, the thickness of each of the end surface layers 9 and 10 may be adjusted by reducing the thickness by the cutting in a subsequent step.

It is preferable that the first end surface layer 9 and the second end surface layer 10 be provided with a color different from that of the low-strength layer 11 by adding a pigment such as cobalt, for example. As such, the end surface layers 9 and 10 and the low-strength layer 11 have an appearance that can be visually distinguished from each other. This is to facilitate detection when the multilayer inductor 1 tips over or the like during mounting.

Among the low-strength layers 11, the low-strength layers 11-2 to 11-7 configure a low-strength intermediate layer in which the circulation portion 23 of the coil conductor 20 is disposed. Therefore, the reference numerals "11-2" to "11-7" are also used for the low-strength intermediate layer.

Further, the low-strength layer 11-1 and the low-strength layers 11-8 and 11-9 configure a first low-strength outer side layer and a second low-strength outer side layer that are positioned so as to sandwich the above-described low-strength intermediate layers 11-2 to 11-7 while being adjacent to the first end surface layer 9 and the second end surface layer 10, respectively. Thus, the reference numeral "11-1" is also used for the first low-strength outer side layer, and the reference numerals "11-8" and "11-9" are also used for the second low-strength outer side layer.

Hereinafter, the formation modes of the circulation portion 23 and the like configuring the coil conductor 20 will be described in an order from the low-strength layer 11-1 toward the low-strength layer 11-9.

1. A conductor is not provided in the first low-strength outer side layer 11-1 adjacent to the first end surface layer 9.

2. A first end conductor piece 21-1 that serves as a part of the first end portion 21 of the coil conductor 20 providing the first terminal electrode 27 is provided in the low-strength intermediate layer 11-2 in a state of passing through the low-strength intermediate layer 11-2 in the thickness direction, i.e., in the lamination direction.

Although not illustrated, a second end conductor piece, that serves as a part of the second end portion 22 of the coil conductor 20 providing the second terminal electrode 28 is also provided in the low-strength intermediate layer 11-2 at a position symmetrical to the first end portion conductor piece 21-1.

3. A first end conductor piece 21-2 that serves as a part of the first end portion 21 providing the first terminal electrode 27 is provided in the low-strength intermediate layer 11-3 in a state of passing through the low-strength intermediate layer 11-3 in the thickness direction.

In addition, a second end conductor piece 22-2 that serves as a part of the second end portion 22 providing the second terminal electrode 28 is provided in the low-strength intermediate layer 11-3 in a state of passing through the low-strength intermediate layer 11-3 in the thickness direction.

At an interface between the low-strength intermediate layers 11-2 and 11-3, a circulation portion 23-1 with one end portion being connected to the second end conductor piece 22-2 is provided, and a via pad 25-1 is provided at another end portion of the circulation portion 23-1. Although not illustrated, a via-hole conductor 24-1 that passes through the low-strength intermediate layer 11-3 in the thickness direction is provided so as to be connected to the via pad 25-1.

4. A first end conductor piece 21-3 that serves as a part of the first end portion 21 providing the first terminal electrode 27 is provided in the low-strength intermediate layer 11-4 in a state of passing through the low-strength intermediate layer 11-4 in the thickness direction.

In addition, a second end conductor piece 22-3 that serves as a part of the second end portion 22 providing the second terminal electrode 28 is provided in the low-strength intermediate layer 11-4 in a state of passing through the low-strength intermediate layer 11-4 in the thickness direction.

At an interface between the low-strength intermediate layers 11-3 and 11-4, a circulation portion 23-2 is provided, and via pads 25-2 and 25-3 are provided at both end portions of the circulation portion 23-2. The via pad 25-2 is connected to the via-hole conductor 24-1 described above. On the other hand, a via-hole conductor 24-2 passing through the low-strength intermediate layer 11-4 in the thickness direction is provided so as to be connected to the via pad 25-3.

5. A first end conductor piece 21-4 that serves as a part of the first end portion 21 providing the first terminal electrode 27 is provided in the low-strength intermediate layer 11-5 in a state of passing through the low-strength intermediate layer 11-5 in the thickness direction.

In addition, a second end conductor piece 22-4 that serves as a part of the second end portion 22 providing the second terminal electrode 28 is provided in the low-strength intermediate layer 11-5 in a state of passing through the low-strength intermediate layer 11-5 in the thickness direction.

At an interface between the low-strength intermediate layers 11-4 and 11-5, a circulation portion 23-3 is provided, and via pads 25-4 and 25-5 are provided at both end portions of the circulation portion 23-3. The via pad 25-4 is connected to the via-hole conductor 24-2 described above. On the other hand, a via-hole conductor 24-3 passing through the low-strength intermediate layer 11-5 in the thickness direction is provided so as to be connected to the via pad 25-5.

6. A first end conductor piece 21-5 that serves as a part of the first end portion 21 providing the first terminal electrode 27 is provided in the low-strength intermediate layer 11-6 in a state of passing through the low-strength intermediate layer 11-6 in the thickness direction.

In addition, a second end conductor piece 22-5 that serves as a part of the second end portion 22 providing the second terminal electrode 28 is provided in the low-strength intermediate layer 11-6 in a state of passing through the low-strength intermediate layer 11-6 in the thickness direction.

At an interface between the low-strength intermediate layers 11-5 and 11-6, a circulation portion 23-4 is provided, and via pads 25-6 and 25-7 are provided at both end portions of the circulation portion 23-4. The via pad 25-6 is connected to the via-hole conductor 24-3 described above. On the other hand, a via-hole conductor 24-4 passing through the low-strength intermediate layer 11-6 in the thickness direction is provided so as to be connected to the via pad 25-7.

7. A first end conductor piece 21-6 that serves as a part of the first end portion 21 providing the first terminal electrode 27 is provided in the low-strength intermediate layer 11-7 in a state of passing through the low-strength intermediate layer 11-7 in the thickness direction.

In addition, a second end conductor piece 22-6 that serves as a part of the second end portion 22 providing the second terminal electrode 28 is provided in the low-strength intermediate layer 11-7 in a state of passing through the low-strength intermediate layer 11-7 in the thickness direction.

At an interface between the low-strength intermediate layers 11-6 and 11-7, a circulation portion 23-5 extending to the first end conductor piece 21-6 is provided, and a via pad 25-8 is provided at an end portion of the circulation portion 23-5. The via pad 25-8 is connected to the via-hole conductor 24-4 described above.

8. The second low-strength outer side layers 11-8 and 11-9 are not provided with a conductor. The second end surface layer 10 is disposed adjacent to the second low-strength outer side layer 11-9.

For the patterning of each portion of the coil conductor 20 and the low-strength intermediate layers 11-2 to 11-7 described above, for example, a photolithography method, a semi-additive method, a screen printing method, and a transfer method are applied.

Further, in the actual manufacturing process, a mother multilayer body from which a plurality of component main bodies 2 can be taken is produced by cutting, and is cut to obtain a multilayer body chip to be the component main body 2 for each multilayer inductor 1. Also, when the end surface layers 9 and 10 and the low-strength layer 11 contain glass, the multilayer body chip is then fired. In a case where the end surface layers 9 and 10 and the low-strength layer 11 are made of a resin as a main component, a process for solidifying the resin is then applied. The component main body 2 thus obtained is subjected to barrel polishing processing as necessary, then the plating films 29 and 30 are formed, and the multilayer inductor 1 is completed.

The multilayer inductor 1 according to the first embodiment described above also has the following features.

A coil axis provided by the coil conductor 20 extends in a direction orthogonal to the first end surface 3 and the second end surface 4 of the component main body 2. Therefore, when the multilayer inductor 1 is mounted in or on the mounting substrate, a direction of the magnetic flux generated in the coil conductor 20 is parallel to a mounting surface.

As described above, when the direction of the magnetic flux is parallel to the mounting surface, the magnetic flux is prevented from being blocked by the mounting substrate, so that it is possible to bring the electrical characteristics close to the ideal value. Incidentally, when the magnetic flux is blocked, a reverse current flows by an amount of the blocked magnetic flux, an electric resistance increases, and a Q value decreases.

Further, a description will be given referring to FIG. 3, it is more preferable that a total thickness (T1+T2) of a thickness T1 of the first end surface layer 9 and a thickness T2 of the first low-strength outer side layer 11-1 and a total thickness (T3+T4) of a thickness T3 of the second end surface layer 10 and a thickness T4 of the second low-strength outer side layers 11-8 and 11-9 be equal to each other, but even though there is a difference between the total thicknesses, the difference is preferably equal to or less than about 3 μm.

In this embodiment, in order to improve the mechanical strength, in the component main body 2, the first end surface layer 9 and the first low-strength outer side layer 11-1, and the second end surface layer 10 and the second low-strength outer side layers 11-8 and 11-9 have an asymmetrical form, however, as described above, by setting (T1+T2)=(T3+T4), the coil conductor 20 in the component main body 2 is located at the center of the multilayer inductor 1 as a whole, and it can be arranged in a point-symmetric manner. Therefore, the magnetic flux emitted from the multilayer inductor 1 may be made in a symmetric form. Incidentally, when the coil conductor is asymmetrically arranged inside the component main body, the magnetic flux emitted from the multilayer inductor also becomes asymmetric, and undesirably, the influence on the other electronic components becomes asymmetric.

Further, a description will be given referring to FIG. 3, when being compared at the same position in a direction connecting the top surface 7 and the bottom surface 8, it is preferable that a distance L1 from an end edge 31 of each of the first terminal electrode 27 and the second terminal electrode 28 (see FIG. 1) on a side of the first end surface 3 to the first end surface 3 be equal to a distance L2 from an end edge 32 of each of the first terminal electrode 27 and the second terminal electrode 28 on a side of the second end surface 4 to the second end surface 4.

Also with the above-described configuration, the coil conductor 20 in the component main body 2 is located at the center in the multilayer inductor 1 as a whole, and can be arranged in a point-symmetric manner. Therefore, the magnetic flux emitted from the multilayer inductor 1 may be made in a symmetric form.

Further, a description will be given with reference to FIG. 3, in the present embodiment, when being compared at the same position in the direction connecting the top surface 7 and the bottom surface 8, a distance T1 from an interface between the first end surface layer 9 and the first low-strength outer side layer 11-1 to the first end surface 3 is longer than a distance T2 from the interface between the first end surface layer 9 and the first low-strength outer side layer 11-1 to the end edge of each of the first terminal electrode 27 and the second terminal electrode 28 on the side of the first end surface 3, and a distance T3 from an interface between the second end surface layer 10 and the second low-strength outer side layer 11-9 to the second end surface 4 is shorter than a distance T4 from the interface between the second end surface layer 10 and the second low-strength outer side layer 11-9 to an end edge of each of the first terminal electrode 27 and the second terminal electrode 28 on the side of the second end surface 4.

As a result of the above-described configuration, the coil conductor 20 in the component main body 2 can be positioned at the center of the multilayer inductor 1 as a whole, and can be arranged in a point-symmetric manner.

Figure 4:
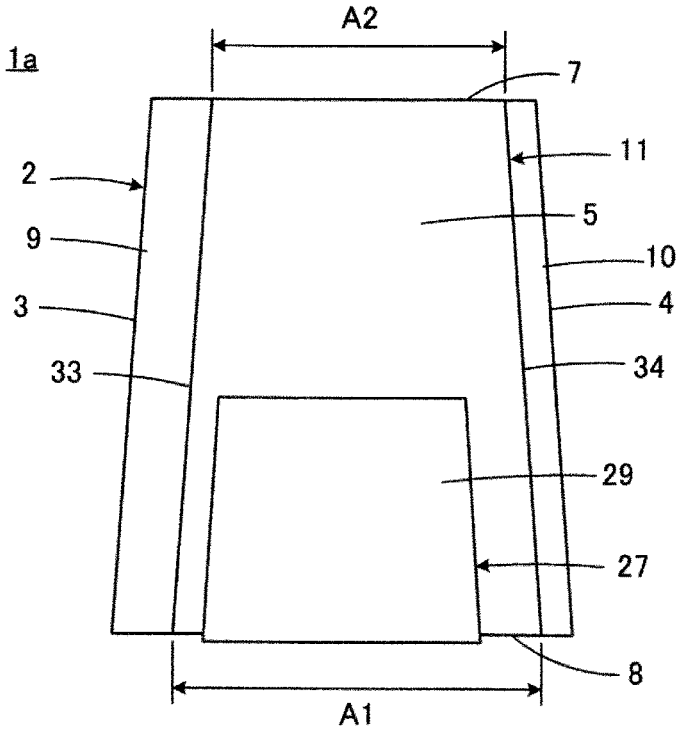
FIG. 4 is a side view illustrating a multilayer inductor according to a second embodiment of the present disclosure from a direction of the first side surface.
Figure 5:
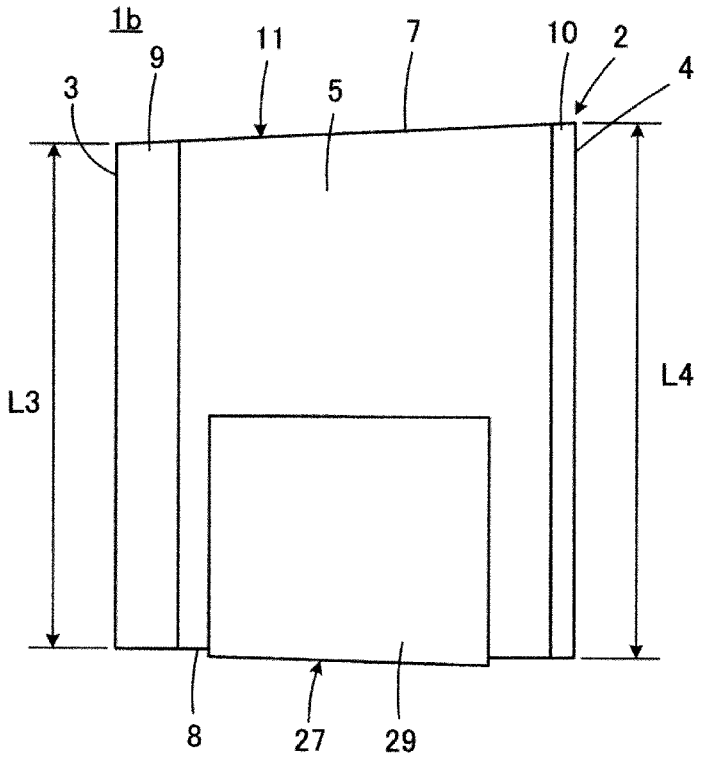
FIG. 5 is a side view illustrating a multilayer inductor according to a third embodiment of the present disclosure from a direction of the first side surface.

Next, a description will be given of a form of a multilayer inductor that is likely to be produced when a multilayer inductor having a feature of the present disclosure is actually manufactured with reference to FIG. 4 and FIG. 5. In FIG. 4 and FIG. 5, elements corresponding to the elements illustrated in FIG. 3 are denoted by the same reference numerals, and redundant description thereof will be omitted. Note that, in FIG. 4 and FIG. 5, the features intended to be illustrated in the drawings are exaggerated.

FIG. 4 is a side view illustrating a multilayer inductor 1*a* according to a second embodiment of the present disclosure in a direction of the first side surface 5. In the multilayer inductor 1*a* illustrated in FIG. 4, when viewed from a direction orthogonal to the first side surface 5 or the second side surface 6, intervals A1 and A2 between an interface surface 33 between the first end surface layer 9 and the low-strength layer 11 and an interface 34 between the second end surface layer 10 and the low-strength layer 11 are shorter from the bottom surface 8 toward the top surface 7 (A1>A2). Such a form contributes to stabilization of the multilayer inductor 1*a* during mounting.

A form as illustrated in FIG. 4 is caused by positions of the terminal electrodes 27 and 28 in the component main body 2. That is, the terminal electrodes 27 and 28 are present so as to be biased toward the bottom surface 8 side of the component main body 2. Therefore, when the component main body 2 is pressed in the lamination direction, portions where the terminal electrodes 27 and 28 are not present are more compressed than portions where they are present. As a result, a form as illustrated in FIG. 4 is provided.

FIG. 5 is a side view illustrating a multilayer inductor 1*b* according to a third embodiment of the present disclosure from a direction of the first side surface 5. In the multilayer inductor 1*b* illustrated in FIG. 5, when viewed from a direction orthogonal to the first side surface 5 or the second side surface 6, a length L3 in a direction in which the first end surface 3 of the first end surface layer 9 extends is shorter than a length L4 in a direction in which the second end surface 4 of the second end surface layer 10 extends.

A form as illustrated in FIG. 5 is caused by the following manufacturing process. As described above, in the actual manufacturing process of the multilayer inductor 1*b*, the mother multilayer body from which the plurality of component main bodies 2 can be taken is produced by cutting, and is cut to obtain a multilayer body chip to be the component main body 2 for each multilayer inductor 1. When the mother multilayer body is cut, a cutting blade is inserted from a side of the first end surface layer 9 that is thicker in order to prevent breakage of the product. Since the cutting blade has a cross-sectional shape becoming narrower toward a tip, the first end surface layer 9 side in contact with a root of the cutting blade is compressed more strongly in a vertical direction in FIG. 5. Such processing conditions result in a form as illustrated in FIG. 5.

As such, although the present disclosure has been described in connection with the embodiment illustrated in the drawings, various other modifications are possible within the scope of the present disclosure. For example, in the illustrated embodiment, both of the first end surface layer 9 and the second end surface layer 10 are present, and then the thickness of the first end surface layer 9 is made larger than the thickness of the second end surface layer 10, however, the thickness of the second end surface layer 10 may be about 0, that is, the second end surface layer may be absent.

Further, the embodiments described herein are illustrative, and partial substitutions or combinations of configurations are possible between different embodiments.

In the present disclosure, the end surface layer contributes to an improvement in the mechanical strength of the multilayer inductor. Also, the greater the thickness of the end surface layer is, the further the above-described mechanical strength is improved. However, simply increasing the thickness of the end surface layer leads to an increase in size of the multilayer inductor, which is not preferable.

Therefore, in the present disclosure, instead of simply thickening both of the first end surface layer that provides the first end surface and the second end surface layer that provides the second end surface of the component main body, only the first end surface layer is made thicker, and the second end surface layer is made thinner by only an amount corresponding to an amount of thickening of the first end surface layer, or in some cases, the second end surface is eliminated. As a result, it is possible to avoid an increase in the size of the multilayer inductor.

In addition, under the condition that the total thickness of the first end surface layer and the second end surface layer is constant, when the thickness of the first end surface layer is made larger than the thickness of the second end surface layer, the thickness of the first end surface layer itself can be made larger than in a case where the thicknesses of the first end surface layer and the second end surface layer are equal to each other. The first end surface layer thus thickened can provide a high mechanical strength to the component main body. Therefore, for example, during the reflow soldering process or the deflection test, it is possible to reduce distortion or warpage generated in the multilayer inductor, and therefore it is possible to make it hard for the multilayer inductor to generate a crack.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A multilayer inductor comprising:

a component main body that is made of a non-conductive material, has a rectangular parallelepiped shape or a substantially rectangular parallelepiped shape having a multilayer structure, and has a first end surface and a second end surface positioned at end portions in a lamination direction and opposed each other, a first side surface and a second side surface connecting between the first end surface and the second end surface and opposed each other, and a top surface and a bottom surface connecting between the first end surface and the second end surface and between the first side surface and the second side surface and opposed each other;

a coil conductor that includes a first end portion and a second end portion exposed on an outer surface of the component main body in a mutually reverse manner, is disposed inside the component main body, and includes a circulation portion extending in parallel to the first end surface and the second end surface;

a first terminal electrode configured to include the first end portion of the coil conductor; and a second terminal electrode configured to include the second end portion of the coil conductor, wherein the component main body includes a first end surface layer that provides the first end surface, a second end surface layer that provides the second end surface, and a low-strength layer that has a lower rigidity than the first end surface layer and the second end surface layer, and a thickness of the first end surface layer is larger than a thickness of the second end surface layer.

2. The multilayer inductor according to claim 1, wherein the first end surface layer, the second end surface layer and the low-strength layer have appearances that are visually distinguishable from each other.

3. The multilayer inductor according to claim 1, wherein the first end surface layer is thicker than the second end surface layer by equal to or more than 3 μm.

4. The multilayer inductor according to claim 1, wherein the low-strength layer has a low-strength intermediate layer in which the circulation portion of the coil conductor is disposed, a first low-strength outer side layer adjacent to the first end surface layer, and a second low-strength outer side layer adjacent to the second end surface layer, the first low-strength outer side layer and the second low-strength outer side layer being positioned so as to sandwich the low-strength intermediate layer, and a difference between a total thickness of the first end surface layer and the first low-strength outer side layer and a total thickness of the second end surface layer and the second low-strength outer side layer is equal to or less than 3 μm.

5. The multilayer inductor according to claim 1, wherein the first terminal electrode extends over each part of the first side surface and the bottom surface, and the second terminal electrode extends over each part of the second side surface and the bottom surface.

6. The multilayer inductor according to claim 5, wherein when being compared at the same position in a direction connecting the top surface and the bottom surface, a distance from an end edge of each of the first terminal electrode and the second terminal electrode on a side of the first end surface to the first end surface is equal to a distance from an end edge of each of the first terminal electrode and the second terminal electrode on a side of the second end surface to the second end surface.

7. The multilayer inductor according to claim 5, wherein when being compared at the same position in a direction connecting the top surface and the bottom surface, a distance from an interface between the first end surface layer and the first low-strength outer side layer to the first end surface is longer than a distance from an interface between the first end surface layer and the first low-strength outer side layer to an end edge of each of the first terminal electrode and the second terminal electrode on a side of the first end surface, and a distance from an interface between the second end surface layer and the second low-strength outer side layer to the second end surface is shorter than a distance from an interface between the second end surface layer and the second low-strength outer side layer to an end edge of each of the first terminal electrode and the second terminal electrode on a side of the second end surface.

8. The multilayer inductor according to claim 1, wherein an interval between an interface between the first end surface layer and the low-strength layer and an interface between the second end surface layer and the low-strength layer becomes shorter from the bottom surface toward the top surface when viewed from a direction orthogonal to the first side surface or the second side surface.

9. The multilayer inductor according to claim 1, wherein a length of the first end surface layer in an extending direction of the first end surface is shorter than a length of the second end surface layer in an extending direction of the second end surface when viewed from a direction orthogonal to the first side surface or the second side surface.

10. The multilayer inductor according to claim 1, wherein a coil axis provided by the coil conductor extends in a direction orthogonal to the first end surface and the second end surface.

11. The multilayer inductor according to claim 1, wherein the first terminal electrode includes a first plating film formed so as to cover the first end portion, and the second terminal electrode includes a second plating film formed so as to cover the second end portion.

12. The multilayer inductor according to claim 2, wherein the first end surface layer is thicker than the second end surface layer by equal to or more than 3 μm.

13. The multilayer inductor according to claim 2, wherein the low-strength layer has a low-strength intermediate layer in which the circulation portion of the coil conductor is disposed, a first low-strength outer side layer adjacent to the first end surface layer, and a second low-strength outer side layer adjacent to the second end surface layer, the first low-strength outer side layer and the second low-strength outer side layer being positioned so as to sandwich the low-strength intermediate layer, and a difference between a total thickness of the first end surface layer and the first low-strength outer side layer and a total thickness of the second end surface layer and the second low-strength outer side layer is equal to or less than 3 μm.

14. The multilayer inductor according to claim 2, wherein the first terminal electrode extends over each part of the first side surface and the bottom surface, and the second terminal electrode extends over each part of the second side surface and the bottom surface.

15. The multilayer inductor according to claim 6, wherein when being compared at the same position in a direction connecting the top surface and the bottom surface, a distance from an interface between the first end surface layer and the first low-strength outer side layer to the first end surface is longer than a distance from an interface between the first end surface layer and the first low-strength outer side layer to an end edge of each of the first terminal electrode and the second terminal electrode on a side of the first end surface, and a distance from an interface between the second end surface layer and the second low-strength outer side layer to the second end surface is shorter than a distance from an interface between the second end surface layer and the second low-strength outer side layer to an end edge of each of the first terminal electrode and the second terminal electrode on a side of the second end surface.

16. The multilayer inductor according to claim 2, wherein an interval between an interface between the first end surface layer and the low-strength layer and an interface between the second end surface layer and the low-strength layer becomes shorter from the bottom surface toward the top surface when viewed from a direction orthogonal to the first side surface or the second side surface.

17. The multilayer inductor according to claim 2, wherein a length of the first end surface layer in an extending direction of the first end surface is shorter than a length of the second end surface layer in an extending direction of the second end surface when viewed from a direction orthogonal to the first side surface or the second side surface.

18. The multilayer inductor according to claim 2, wherein a coil axis provided by the coil conductor extends in a direction orthogonal to the first end surface and the second end surface.

19. The multilayer inductor according to claim 2, wherein the first terminal electrode includes a first plating film formed so as to cover the first end portion, and the second terminal electrode includes a second plating film formed so as to cover the second end portion.

20. A multilayer inductor comprising:

a component main body that is made of a non-conductive material, has a rectangular parallelepiped shape or a substantially rectangular parallelepiped shape having a multilayer structure, and has a first end surface and a second end surface positioned at end portions in a lamination direction and opposed each other, a first side surface and a second side surface connecting between the first end surface and the second end surface and opposed each other, and a top surface and a bottom surface connecting between the first end surface and the second end surface and between the first side surface and the second side surface and opposed each other;

a coil conductor that includes a first end portion and a second end portion exposed on an outer surface of the component main body in a mutually reverse manner, is disposed inside the component main body, and includes a circulation portion extending in parallel to the first end surface and the second end surface;

a first terminal electrode configured to include the first end portion of the coil conductor; and a second terminal electrode configured to include the second end portion of the coil conductor, wherein the component main body includes a first end surface layer providing the first end surface, and a low-strength layer providing the second end surface and having a lower rigidity than the first end surface layer.

* * * * *